US007631731B2

(12) United States Patent
Maki et al.

(10) Patent No.: US 7,631,731 B2
(45) Date of Patent: Dec. 15, 2009

(54) ELEVATOR

(75) Inventors: Jukka Maki, Helsinki (FI); Juha Tyllinen, Tervakoski (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 12/328,427

(22) Filed: Dec. 4, 2008

(65) Prior Publication Data

US 2009/0139802 A1 Jun. 4, 2009

Related U.S. Application Data

(63) Continuation of application No. PCT/FI2007/000153, filed on Jun. 4, 2007.

(30) Foreign Application Priority Data

Jun. 5, 2006 (FI) ..... 20060548

(51) Int. Cl.
*B66B 1/34* (2006.01)

(52) U.S. Cl. ..... 187/393; 177/147

(58) Field of Classification Search ..... 187/277, 187/281, 391, 393; 177/132, 142, 147; 73/1.09, 73/1.13, 1.15, 763, 783, 796, 811
See application file for complete search history.

(56) References Cited

U.S. PATENT DOCUMENTS 6,305,503 B1 * 10/2001 Suzuki et al. ..... 187/393
6,325,179 B1 * 12/2001 Barreiro et al. ..... 187/393
6,715,587 B2 * 4/2004 Sittler et al. ..... 187/401
7,237,656 B2 * 7/2007 Barrett et al. ..... 187/412
7,493,834 B2 * 2/2009 Gonzalez Gallegos . 73/862.391
2008/0271954 A1 * 11/2008 Fischer ..... 187/281

FOREIGN PATENT DOCUMENTS

| | | | |
|---|---|---|---|
| EP | 0 776 857 | A2 | 6/1997 |
| EP | 1 431 227 | A1 | 6/2004 |
| WO | WO-01/83350 | A1 | 11/2001 |
| WO | WO-2004/067429 | A1 | 8/2004 |
| WO | WO-2005/0471 | A1 | 1/2005 |

* cited by examiner

*Primary Examiner*—Jonathan Salata
(74) *Attorney, Agent, or Firm*—Birch, Stewart, Kolasch & Birch, LLP

(57) ABSTRACT

The present invention relates to an elevator and a method for measuring the load in an elevator, in which the elevator car is suspended on hoisting ropes with at least one upward-directed diverting pulley or diverting pulley pair, from which the elevator ropes go upwards on both sides, and at least one downward-directed diverting pulley or diverting pulley pair, from which the elevator ropes go downwards on both sides. In the elevator at least one upward-directed diverting pulley or diverting pulley pair and at least one downward-directed diverting pulley or diverting pulley pair is fixed to the elevator car with a shared supporting structure. In the method the tension information is measured from a supporting structure and a load-weighing signal is formed using the tension information obtained.

13 Claims, 3 Drawing Sheets

ELEVATOR

Figure 1:
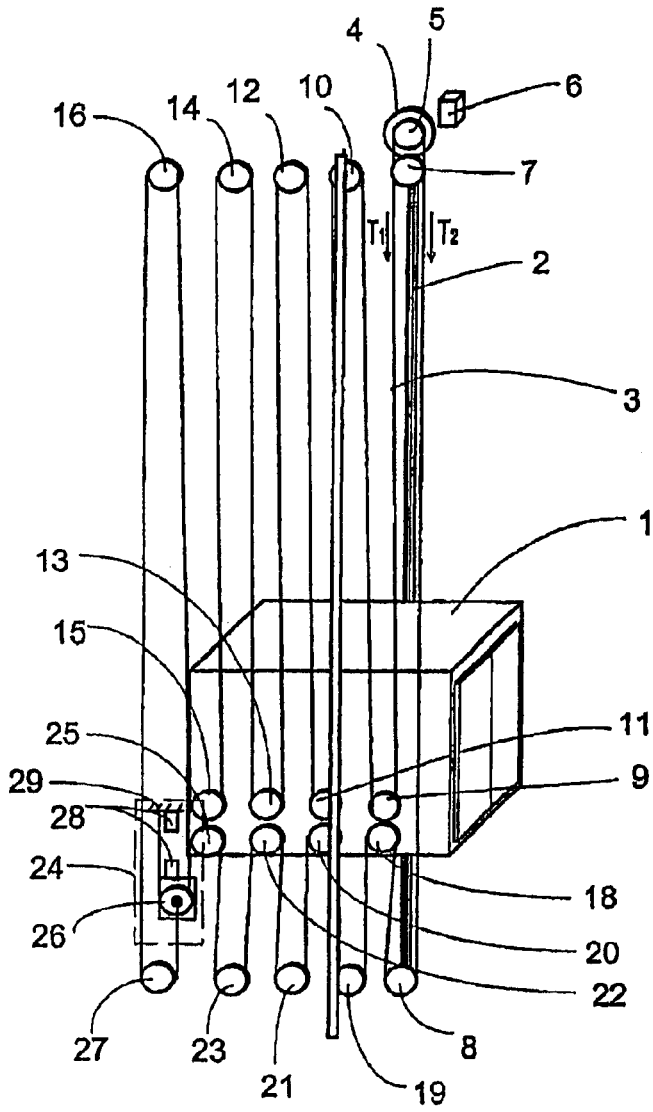

This application is a Continuation of copending PCT International Application No. PCT/FI2007/000153 filed on Jun. 4, 2007, which designated the United States, and on which priority is claimed under 35 U.S.C. § 120. This application also claims priority under 35 U.S.C. § 119(a) on Patent Application No(s). 20060548 filed in Finland on Jun. 5, 2006. The entire contents of each of the above documents is hereby incorporated by reference.

The present invention relates to a method as defined in the preamble of claim 1 and an elevator as defined in the preamble of claim 5.

A weight limit is generally set for elevator cars, especially in traction sheave elevators, which the combined weight of the car and load may not exceed. If the weight limit is exceeded, the elevator cannot for safety reasons start moving. Too much weight can e.g. cause damage to the machinery or to the hoisting ropes or can be a safety risk for passengers. Elevators must thus contain an apparatus that measures the weight of the car and the load and if the weight limit is exceeded gives notification with a signaling device and prevents the car from starting to move by locking the brake of the elevator and also by preventing the elevator motor from starting. The elevator car cannot be allowed to move before the overload is removed. It is also possible to use the load-measuring device of the elevator car for other control of the elevator as well as for receiving overload information, such as for positioning of the start. Likewise it is possible to use the load-measuring device also during travel of the elevator car.

In prior art the load of the elevator car is measured with apparatuses disposed below the elevator car as well as with apparatuses fastened to the hoisting ropes. A drawback of load measuring devices disposed below the elevator car is that they are also expensive and awkward to install, and are not as such applicable as a load-weighing apparatus of an elevator without counterweight or of an elevator suspended with a suspension ratio of 2:1 or higher.

Prior art also includes load-measuring devices that use strain gauges fastened to the hoisting ropes of the elevator, which are generally located on a steel structure of the fixing of the hoisting ropes. A problem with this solution is that, owing to the safety factor set by the regulations for a load-bearing structure, the structure to which the strain gauges are fixed must be made strong so that it does not elongate much. For this reason it is difficult to accurately measure the strain and as a result of this the margins of error of measurements are great.

There are also prior art apparatuses in which the hoisting ropes are passed over some kinds of bars, and the load of the elevator car is measured by means of these. A drawback of this solution is that there are numerous bendings in the hoisting rope over a short distance, which stress and wear the hoisting rope.

The object of this invention is to eliminate the aforementioned drawbacks and to achieve a simple and low-cost load-weighing appliance of an elevator, which measures accurately the weight of the elevator car and its load. The aim is to achieve a load-weighing arrangement which is applicable especially for the load measurement of elevator cars suspended with a suspension ratio of 2:1 or higher, especially as a load-weighing apparatus of preferably elevator solutions without counterweight. The aim of the load-weighing apparatus according to the invention is to achieve a load-weighing arrangement that is suitable for use in almost all elevator solutions.

The method according to the invention is characterized by what is disclosed in the characterization part of claim 1. The elevator according to the invention is characterized by what is disclosed in the characterization part of claim 5. Other embodiments of the invention are characterized by what is disclosed in the other claims. Some inventive embodiments are also discussed in the descriptive section of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts.

In the method according to the invention for measuring the load in an elevator, in which the elevator car is suspended on hoisting ropes with at least one upward-directed diverting pulley or diverting pulley pair, from which the elevator ropes go upwards on both sides, and at least one downward-directed diverting pulley or diverting pulley pair, from which the elevator ropes go downwards on both sides. In the elevator at least one upward-directed diverting pulley or diverting pulley pair and at least one downward-directed diverting pulley or diverting pulley pair is fixed to the elevator car with a shared supporting structure. In the method the tension information is measured from a supporting structure and a load-weighing signal is formed using the tension information obtained. Tension information in the method is measured from a supporting structure at a point in which there is the reciprocal tensile stress of an upward-directed diverting pulley or diverting pulley pair and a downward-directed diverting pulley or diverting pulley pair and/or tension is measured from a supporting structure at a point that transmits the support force of the supporting structure to the elevator car. Tension information is measured preferably from at least two supporting structures and from this tension information a load-weighing signal is formed.

In the elevator according to the invention, in which the elevator car is suspended on hoisting ropes with at least one upward-directed diverting pulley or diverting pulley pair, from which the elevator ropes go upwards on both sides, and at least one downward-directed diverting pulley or diverting pulley pair, from which the elevator ropes go downwards on both sides, and in which elevator at least one upward-directed diverting pulley or diverting pulley pair and at least one downward-directed diverting pulley or diverting pulley pair is fixed to the elevator car with a shared supporting structure, a tension-measuring sensor is connected to the supporting structure. The elevator also comprises means for using the signal of the tension-measuring sensor to form load-weighing information. The tension-measuring sensor is preferably on a point on the supporting structure which is between the upward-directed diverting pulley or diverting pulley pair and the downward-directed diverting pulley or diverting pulley pair and/or the tension-measuring sensor is on a point on the supporting structure which transmits the support force of the supporting structure to the elevator car. The sensor is on at least the supporting structure and in that the elevator comprises means for using at least two signals to form load-weighing information.

In one embodiment according to the invention the load-weighing appliance fitted in connection with the elevator car, preferably to the car sling, determines the magnitude of the resultant force lifting the elevator car, on which forces are acting both upwards and downwards. In an elevator suspended with an 8:1 ratio there are five resultant forces directed upwards and in one solution according to the invention two of these resultant forces are measured by means of a load-weighing appliance. The force is thus measured at two points and averaged by means of the load-weighing appliance of the load measurement in order to improve accuracy. In the solution according to the invention there can be one or more measuring points of the resultant force according to need. The resultant force is calculated as the resultant force of the forces exerted upwards and downwards on the diverting pulleys or the diverting pulley pairs.

With the invention, one or more of the following advantages, among others, can be achieved:

- the load-weighing appliance according to the invention is easy and cheap to implement in elevator solutions without counterweight.
- The load-measuring arrangement of the invention is dependable, operationally reliable and of simple construction.
- the invention can be used in elevator solutions both without counterweight and with counterweight
- when there are more than two measuring points the accuracy of the measurement is improved
- load measuring situated on a diverting pulley pair connected to the elevator car is reliable and an easy method to implement
- in the invention preferably diverting pulley pairs allow placement of load measuring points and diverting pulleys on different sides of the elevator car.
- in addition the diverting pulley pairs enable their advantageous placement on the car sling preferably on the lower part of the car sling
- additionally the invention enables easy implementation of a load-weighing function and the diverting pulleys enable placement of the hoisting ropes of the elevator on different sides of the elevator car.

Figure 2:
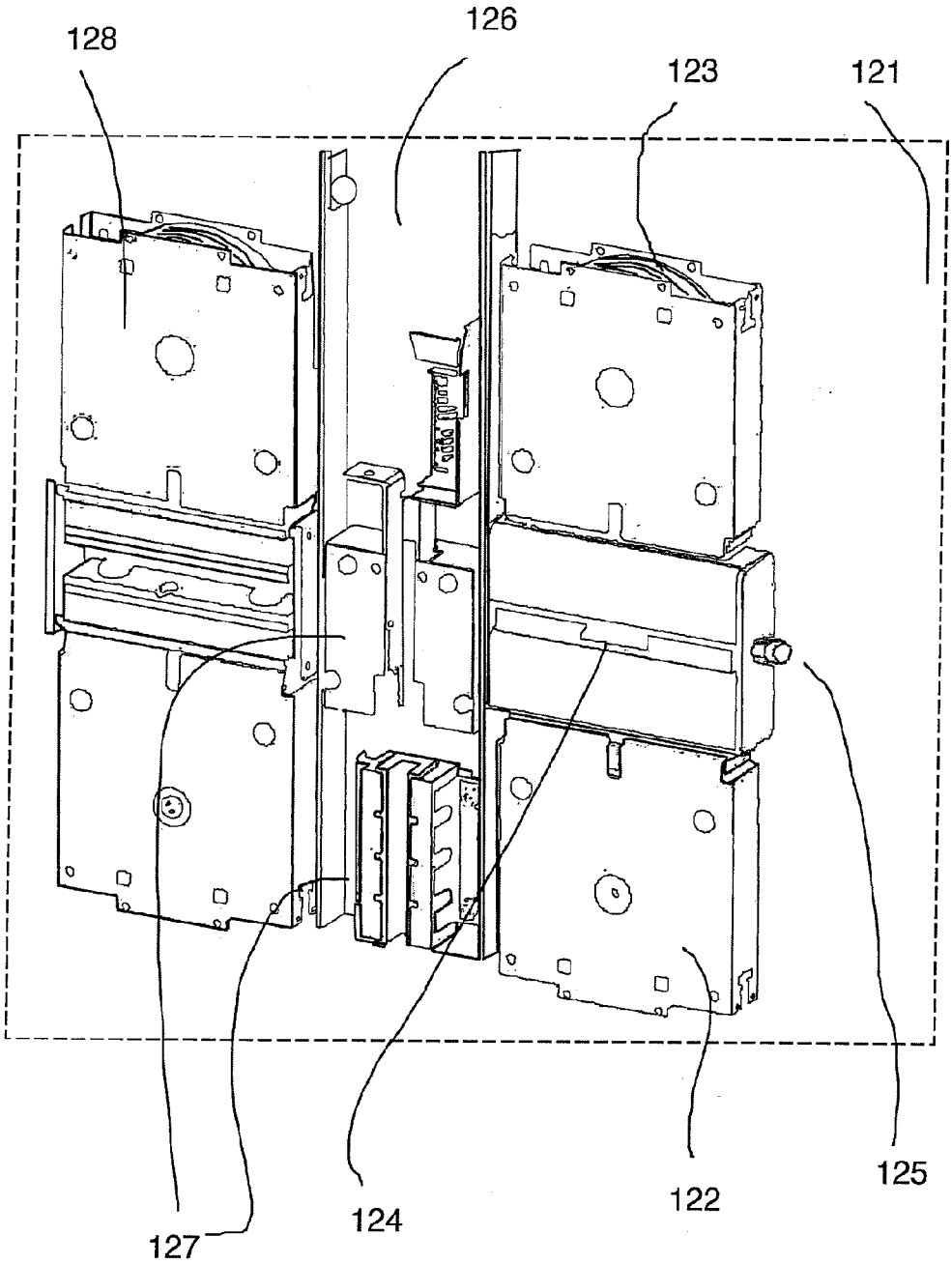

FIG. 1 presents a diagrammatic view of a traction sheave elevator without counterweight according to the invention, FIG. 2 presents a diagrammatic view of a part of the elevator car of the elevator of FIG. 1 and the diverting pulley fixed to it as well as the load-weighing apparatus connected to the diverting pulley.

Figure 3:
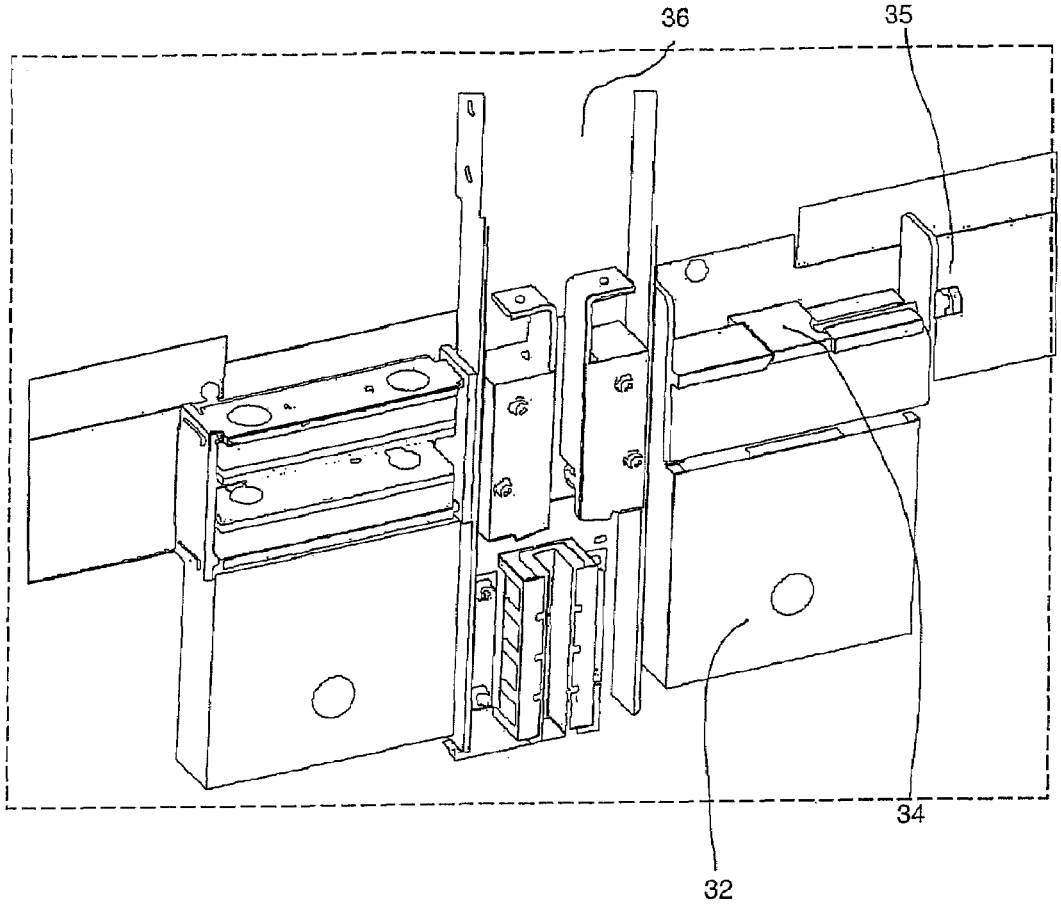

FIG. 3 presents a simplified side view of another elevator and its hoisting ropes that apply the invention as well as a load-weighing apparatus connected to the hoisting ropes, FIG. 1 presents a general illustration of a traction sheave elevator according to the invention, which incorporates load measuring according to the invention. Preferably the elevator is an elevator without machine room and without counterweight, in which the drive machine 4 is disposed in the elevator shaft. The elevator shown in the figure is a traction sheave elevator without counterweight and with machine above, in which the elevator car 1 moves along guide rails 2. In elevators with a large hoisting height, the elongation of the hoisting rope involves a need to compensate the rope elongation, which has to be done reliably within certain permitted limit values. In that case it is essential in respect of elevator operation and safety that the rope portion below the elevator car should be kept sufficiently tight. In the rope force compensating system 24 of the invention presented in FIG. 1, a very long movement for compensating rope elongation is achieved. This enables compensation of also large elongations, which is not often possible with simple lever solutions or with spring solutions. The compensating system 24 of the invention shown in FIG. 1 keeps the rope tensions $T_1$ and $T_2$ acting over the traction sheave at a constant ratio of $T_1/T_2$. In the case presented in FIG. 1 the $T_1/T_2$ ratio is 2/1. With even suspension ratios above and below the elevator car, the compensating system 24 is disposed in the elevator shaft or other place suitable for the purpose that is not connected to the elevator car, and with odd suspension ratios above and below the elevator car the compensating system 24 is connected to the elevator car.

In FIG. 1 the passage of the hoisting ropes is as follows: One end of the hoisting ropes 3 is fixed to the diverting pulley 26 and/or any suspension arrangement for it, said diverting pulley 26 being fitted to rest on the rope portion coming downwards from the diverting pulley 25, which hoisting rope portion passes around diverting pulley 26 and runs further to the fixing point 29 of the other end of the hoisting ropes 3 in the elevator shaft. The compensating system 24 is fitted in place in the elevator shaft. From diverting pulley 26 the hoisting ropes 3 run downwards encountering the diverting pulley 27 situated below the elevator car, preferably in the lower part of the elevator shaft, which the rope passes around via the rope grooves in the diverting pulley 27. These rope grooves can be coated or uncoated, e.g. with friction increasing material, such as polyurethane or other appropriate material. All the diverting pulleys of the elevator or only some and/or the traction sheave can be coated with said material. After passing around diverting pulley 27 the ropes continue upwards to the diverting pulley 16 disposed in the upper part of the elevator shaft, after passing around which the ropes continue downwards to the diverting pulley 15 mounted on the elevator car, after passing around which diverting pullet 15 the rope continues, returning upwards to the diverting pulley 14 disposed in the upper part of the elevator shaft, after passing around which the hoisting ropes continue downwards to the diverting pulley 13 mounted on the elevator car. After passing around diverting pulley 13 the hoisting ropes 3 continue further upwards to the diverting pulley 12 disposed in the elevator shaft, after passing which the ropes 3 continue downwards to the diverting pulley 11 mounted on the elevator car, after passing around which they continue upwards to the diverting pulley 10 disposed in the upper part of the elevator shaft. After passing around diverting pulley 10 the hoisting ropes continue downwards to the diverting pulley 9 mounted on the elevator car, after passing around which the hoisting ropes continue upwards, touching the diverting pulley 7, to the traction sheave 5. The diverting pulley 7 is preferably disposed in the proximity of and/or in connection with the hoisting machine 4. Between the diverting pulley 7 and the traction sheave 5 of the hoisting machine 4 is DW (Double Wrap) roping as presented in the figure, in which roping the hoisting rope 3 passes upwards touching the diverting pulley 7 to the traction sheave 5 and having passed around the traction sheave 5 returns to the diverting pulley 7, after passing around which the hoisting ropes return back to the traction sheave 5. Since the diverting pulley 7 is essentially the same size as the diverting pulley 5 in the Double Wrap roping, the diverting pulley 7 can also act as a damper pulley. In such a case the ropes going from the traction sheave 5 to the elevator car 1 travel via the rope grooves of the diverting pulley 7 and bending of the rope caused by the diverting pulley is very minimal. It could be said that the ropes from the traction sheave 5 going to and coming from the elevator car only "touch" the diverting pulley 7. This kind of "touching" serves as a solution for damping vibration of the outbound ropes and is also applicable in other roping solutions. Other examples of roping solutions include Single Wrap (SW) roping, in which the diverting pulley is substantially the same size as the traction sheave of the drive machine, and in which use of a diverting pulley is applied as the "touching pulley" described above. In the SW roping of the example the ropes pass around the traction sheave only once, in which case the contact angle between the rope and the traction sheave is approximately 180°, the diverting pulley is used only as an aid for the "touching" of the rope in the manner described above, so that the diverting pulley functions as a rope guide and as a damping pulley for damping vibrations or there is no diverting pulley 7 at all. The diverting pulleys 16,15,14,13,12,11,10,9,7 together with the traction sheave 5 of the hoisting machine 4 form the suspension arrangement above the elevator car, the suspension ratio of which is the same as that of the suspension arrangement below the elevator car, said suspension ratio being 8:1 in FIG. 1. The first rope tension $T_1$ acts on the part of the hoisting ropes above the elevator car. After passing around the traction sheave 5 the ropes continue their passage, touching the diverting pulley 7, to the diverting pulley 8, which is preferably disposed in the lower part of the elevator shaft. After passing around diverting pulley 8 the ropes 3 continue upwards to the diverting pulley 18 mounted on the elevator car, after passing around which they continue downwards to the diverting pulley 19 disposed in the lower part of the elevator shaft returning after passing around it to the diverting pulley 20 mounted on the elevator car. After passing around diverting pulley 20 the ropes 3 continue downwards to the diverting pulley 21 disposed in the lower part of the elevator shaft, after passing around which the ropes continue upwards to the diverting pulley 22 mounted on the elevator car. After passing around diverting pulley 22 the hoisting ropes 3 continue downwards to the diverting pulley 23 disposed in the lower part of the elevator shaft, after passing around which the ropes continue upwards to the diverting pulley 25 mounted on the elevator car, after passing around which they continue, returning to the diverting pulley 26 of the compensating system, after passing around which the hoisting ropes continue to the fixing point 29 of the second end, which is in a suitable place in the elevator shaft. The diverting pulleys 8,18,19,20,21,22,23,25,26 form the suspension arrangement of the hoisting rope below the elevator car and a part of the roping. The second rope tension $T_2$ of the hoisting rope acts on this part of the hoisting ropes below the elevator car. The hoisting machine 4 and the traction sheave 5 and/or the diverting pulleys 7,10,12,14,16 disposed in the upper part of the elevator shaft can be fixed in place to the frame structure formed by the guide rails 2 or to a beam structure located at the top end of the elevator shaft or each one separately to the elevator shaft or to any other fixing arrangement suited to the purpose. The diverting pulleys of the lower part of the elevator shaft can be immovably fixed to the frame structure formed by the guide rails 2 or to a beam structure located at the bottom end of the elevator shaft or each one separately to the lower part of the elevator shaft or to any other fixing arrangement suited to the purpose. The diverting pulleys disposed on the elevator car are preferably fitted as diverting pulley pairs such that the diverting pulleys 15, 25 form one pair, from which pair the hoisting ropes of the elevator go both upwards and downwards. The elevator of FIG. 1 contains five of these types of diverting pulley pairs, which other pairs are formed by the diverting pulleys 13,22 and 11,20 and 9,18. The diverting pulleys and/or pair of diverting pulleys on the elevator car can be mounted on the frame structure of the elevator car 1, such as e.g. on the car sling, or on a beam structure or beam structures on the elevator car or each one separately on the elevator car or on any other fixing arrangement suited to the purpose. The diverting pulleys can also be modular in structure, e.g. in such a way that they are separate modular structures, such as e.g. of the cassette type, that are mounted on the shaft structures of the elevator, on the structures of the elevator car and/or car sling or in another appropriate place in the elevator shaft, or in its proximity, or in connection with the elevator car. The diverting pulleys located in the elevator shaft and the devices of the hoisting machine and/or the diverting pulleys connected to the elevator car can be disposed either all on one side of the elevator car in a space between the elevator car and the elevator shaft or otherwise they can be disposed on different sides of the elevator car in the manner desired.

The compensating pulley system 24 for rope force in the elevator that is presented in FIG. 1 compensates rope elongations by means of the movement of the diverting pulley 26. Diverting pulley 26 moves a limited distance thereby equalizing elongations of the hoisting ropes 3. Additionally, the arrangement in question keeps the tension over the traction sheave 5 constant, whereby the ratio between the first and second rope tension, the $T_1/T_2$ ratio, in the case of FIG. 1 is approximately 2/1. Diverting pulley 26, which in FIG. 1 functions as a compensating pulley, can be controlled by means of guide rails to stay on its desired track, especially in situations in which the compensating system 24 receives a powerful impact, such as e.g. during wedge gripping of the elevator. By means of the guides of diverting pulley 26, the distance between the elevator car and the compensating system can be kept to that desired and movement of the compensating system can be kept under control. The guide rails used for the compensating system can be almost any type of guide rails suited to the purpose, such as e.g. guide rails made of metal or other material suitable for the purpose or e.g. rope guides. A buffer 28 can also be fitted to the compensating system 24 to dampen the impacts of the diverting pulleys of the compensating system and/or as a slackening prevention apparatus of the compensating system. The buffer 28 used is disposed e.g. in such a way that the compensating pulley 26 remains supported by the buffer 28 before the rope elongation of the hoisting ropes has had time to fully unlay into the hoisting ropes, especially into the part of the ropes above the elevator car. One design criterion in the elevator of the invention has been to ensure that the compensating system is prevented from feeding rope from the compensating system in the direction of the portions of rope below the elevator car when ranging outside the normal compensation area of the compensating system, thereby maintaining a certain tension in the hoisting ropes. In the compensating system 24 according to the invention the mass of the diverting pulley in the compensating system and of its suspension arrangement and of any additional weights and the additional force caused by them are utilized, which additional force is in the same direction as the first rope tension $T_1$ and thus endeavors to increase the rope tension of the rope portion below the elevator car, in other words the second rope tension $T_2$ increases preferably by the amount of the additional force achieved. The additional force brought about with the arrangement according to the invention is preferably less than 15% of the first rope tension $T_1$, preferably in the range of 5-10% of the first rope tension $T_1$, with which the best advantages are achieved. For example when the combined first rope tension $T_1$ is approx. 3000 N the best possible advantages are obtained with a diverting pulley weighing approx. 20 kg with its suspension and additional weights, the additional force produced by which is in the direction of the first rope tension $T_1$ and the result of gravitation, and which arrangement is suitable for use preferably in DW roping of the traction sheave to ensure a friction grip between the traction sheave and the hoisting ropes when using a compensating system which stabilizes the $T_1/T_2$ ratio at approx. 2/1. Positive effects on the operation of the elevator and its compensating system are achieved by increasing the mass of the diverting pulley and its Q suspension even by only a little, such as e.g. very light additional weights of even below 3 kg. The additional force achievable with the diverting pulley and its suspension and with extra weights cannot however be increased too much in relation to the first rope tension $T_1$, for the elevator and the compensating system used to operate in the desired manner, because increasing the additional force steadily improves the friction between the traction sheave and the hoisting ropes and at the same time the $T_1/T_2$ ratio approaches a zero value, but correspondingly the rope forces continuously increase. In addition to the diverting pulleys of the compensating system and their suspension arrangements, the additional force needed can be produced e.g. by replacing the additional weights with a spring or with another arrangement suited to the purpose. It is also possible to implement the compensating system 24 differently than presented in the forgoing example, such as with more complex suspension arrangements in the compensating system, such as e.g. by arranging different suspension ratios between the diverting pulleys of the compensating system.

In the solution presented in FIG. 1, in which the elevator car has five diverting pulley pairs, the elevator car with its car sling are supported from five different points and preferably the load-weighing function and measurement of the load is preferably implemented from two different measuring points, in which case by calculating the average value of two different measurement results more certain and accurate measurement data about the load is obtained. In the elevator according to the invention there can be only one measuring point or more than one, according to need. The measured signal can be amplified according to need with an amplifier suited to the purpose in order to verify the measurement result.

FIG. 2 presents load measuring according to the invention from the diverting pulley pair 22. The figure presents two diverting pulley pairs 22, 28, which are mounted on the car sling 26 of the elevator car. In the diverting pulley pair 22 only one of the individual diverting pulleys 23 is visible, from both sides of which diverting pulley the hoisting ropes go towards the upper part of the elevator shaft, and on which diverting pulley 23 an upward-directed force is exerted upwards. The hoisting ropes are omitted from the figure for the sake of clarity. The second diverting pulley of the diverting pulley pair 22, from which the hoisting ropes go downwards and on which a downward force is exerted, is inside the enclosure 22. The diverting pulley pair 22 is mounted on the car sling 26 via a strain gauge 24. The diverting pulleys are tightened into position in the enclosure of the diverting pulley pair 22 by means of the screw 25. FIG. 3 better presents the diverting pulley pair fixed by means of the strain gauge 24. The strain gauge 24 is mounted on the elevator car and/or on its sling. The diverting pulley pairs participating in load measuring are mounted on the elevator car and/or on the car sling via the strain gauge 24. The strain gauge 24 can be any rigid material whatever that is suited to the purpose. Load measuring is implemented by means of the strain gauge 24, in which gauge is disposed a sensor suited to the purpose for forming a load-weighing signal. In addition the elevator contains apparatuses for calculating the magnitude of the load of the elevator based on the load-weighing signal of the elevator. The elements 27 in FIG. 2 are other elements essential from the standpoint of the operation of the elevator.

FIG. 3 presents a cross-section of the diverting pulley pair 22. The diverting pulley 32, from which the hoisting ropes go downwards is presented inside an enclosure in FIG. 3. The diverting pulley 32 is mounted on the elevator car via the strain gauge 34. It is tightened against the strain gauge with the tightening element 35. The upper diverting pulley of the diverting pulley pair, from which the hoisting ropes go upwards is not shown in the figure. The force $T_1$ acting on the suspension above the elevator car exerted on the hoisting ropes is thus exerted on the strain gauge 34 upwards and the force $T_2$ acting on the suspension below the elevator car exerted on the hoisting ropes is thus exerted on it downwards. The resultant force of these forces is thus exerted on the strain gauge 34, which is produced as the result of these forces. From this resultant force a load-weighing signal is formed by means of the sensor, by means of which load measuring is implemented.

It is obvious to the person skilled in the art that the invention is not limited to the embodiments described above, in which the invention is described using examples, but that many adaptations and different embodiments of the invention are possible within the scope of the inventive concept defined by the claims presented below. Thus for instance the type of suspension methods and the number of diverting pulleys used in elevators applying the invention can differ to what is presented above.

It is also obvious to the person skilled in the art that the structure and position of the load-weighing apparatuses presented can be different to what is described above. It is also obvious to the person skilled in the art that the elevator car can be suspended with almost suspension ratio suited to the purpose, such as e.g. 2:1, 3:1, 4:1, 5:1, 6:1, 7:1, 8:1, 9:1 or 10:1 or with an even greater suspension ratio. In certain cases the method according to the invention is applicable for use in elevators with 1:1 suspension ratio. It is also obvious to the person skilled in the art that the compensating system of an elevator without counterweight according to the invention can be implemented in a different manner than that presented in the example, such as e.g. by means of a lever or compensating pulley system or by means of some other compensating apparatus suited to the purpose.

It is obvious to the skilled person that the elevator of the invention can be implemented using almost any type of flexible hoisting means as hoisting ropes, e.g. flexible rope of one or more strands, flat belt, cogged belt, trapezoidal belt or some other type of belt applicable to the purpose. It is also obvious to the skilled person that, instead of using ropes with a filler, the invention may be implemented using ropes without filler, which are either lubricated or unlubricated. In addition, it is also obvious to the skilled person that the ropes may be twisted in many different ways.

It is also obvious to the person skilled in the art that the elevator of the invention can be implemented using different roping arrangements between the traction sheave and the diverting pulley/diverting pulleys to increase the contact angle $\alpha$ than the roping arrangements described as examples. For example, it is possible to dispose the diverting pulley/diverting pulleys, the traction sheave and the hoisting ropes in another way than in the roping arrangements described as examples. It is also obvious to the person skilled in the art that in the elevator according to the invention the elevator can be provided with a counterweight, in which elevator e.g. the counterweight preferably weighs less than the car and it is suspended with different roping, the elevator car is supported partly by means of the hoisting ropes and partly by means of the counterweight and its roping.

The invention claimed is:

1. In the method for measuring the load in a elevator, in which the elevator car is suspended on the hoisting ropes with at least one upward-directed diverting pulley or diverting pulley pair, from which the elevator ropes go upwards on both sides, and at least one downward-directed diverting pulley or diverting pulley pair, from which the elevator ropes go downwards on both sides, and in which elevator at least one upward-directed diverting pulley or diverting pulley pair and at least one downward-directed diverting pulley or diverting pulley pair is fixed to the elevator car with a shared supporting structure, wherein tension-measuring information is measured from the shared supporting structure of said upward-directed diverting pulley or diverting pulley pair and one downward-directed diverting pulley or diverting pulley pair and in that a load-weighing signal is formed using the tension information received.

2. Method according to claim 1, wherein tension is measured from a supporting structure at a point in which there is the reciprocal tensile stress of an upward-directed diverting pulley or diverting pulley pair and a downward-directed diverting pulley or diverting pulley pair.

3. Method according to claim 1, wherein tension is measured from a supporting structure at a point that transmits the support force of the supporting structure to the elevator car.

4. Method according to claim 1 wherein tension information is measured from at least two supporting structures and from this tension information a load-weighing signal is formed.

5. Elevator in which the elevator car is suspended on hoisting ropes with at least one upward-directed diverting pulley or diverting pulley pair, from which the elevator ropes go upwards on both sides, and at least one downward-directed diverting pulley or diverting pulley pair, from which the elevator ropes go downwards on both sides, and in which elevator at least one upward-directed diverting pulley or diverting pulley pair and at least one downward-directed diverting pulley or diverting pulley pair is fixed to the elevator car with a shared supporting structure, wherein a tension-measuring sensor is connected to the shared supporting structure of said upward-directed diverting pulley or diverting pulley pair and one downward-directed diverting pulley or diverting pulley pair and in that the elevator comprises means for using the signal of the tension-measuring sensor to form load-weighing information.

6. Elevator according to claim 5 wherein the tension-measuring sensor is on a point on the supporting structure which is between the upward-directed diverting pulley or diverting pulley pair and the downward-directed diverting pulley or diverting pulley pair.

7. Elevator according to claim 5 wherein the tension-measuring sensor is on the supporting structure at a point which transmits the support force of the supporting structure to the elevator car.

8. Elevator according to claim 5, wherein the sensor is on at least the supporting structure and in that the elevator comprises means for using at least two signals to form load-weighing information.

9. Method according to claim 2 wherein tension information is measured from at least two supporting structures and from this tension information a load-weighing signal is formed.

10. Method according to claim 3 wherein tension information is measured from at least two supporting structures and from this tension information a load-weighing signal is formed.

11. Method according to claim 4 wherein tension information is measured from at least two supporting structures and from this tension information a load-weighing signal is formed.

12. Elevator according to claim 6 wherein the sensor is on at least the supporting structure and in that the elevator comprises means for using at least two signals to form load-weighing information.

13. Elevator according to claim 7 wherein the sensor is on at least the supporting structure and in that the elevator comprises means for using at least two signals to form load-weighing information.

* * * * *